United States Patent [19]

Rushing

[11] Patent Number: 4,724,461

[45] Date of Patent: Feb. 9, 1988

[54] DYNAMIC PROCESS CONTROL FOR ELECTROSTATOGRAPHIC MACHINES

[75] Inventor: Allen J. Rushing, Webster, N.Y.

[73] Assignee: Eastman Kodak Company, Rochester, N.Y.

[21] Appl. No.: 34,363

[22] Filed: Apr. 6, 1987

[51] Int. Cl.[4] ..... G03G 15/00

[52] U.S. Cl. ..... 355/14 D; 355/14 E; 355/14 C

[58] Field of Search ..... 355/14 D, 14 CH, 14 E, 355/14 R, 14 C; 118/665, 688

[56] References Cited

U.S. PATENT DOCUMENTS 2,956,487 10/1960 Giaimo, Jr. .
3,611,982 10/1971 Coriale .
4,213,693 7/1980 Imai et al. ..... 355/14 D
4,502,778 3/1985 Dodge et al. ..... 355/14 D X

*Primary Examiner*—A. T. Grimley

*Assistant Examiner*—J. Pendergrass

*Attorney, Agent, or Firm*—Milton S. Sales

[57] ABSTRACT

An electrostatographic machine has both (1) feedback means for adjusting process control parameters in response to long term variations in the electrostatographic process and (2) feedforward means for adjusting process control parameters in response to short term variations in the electrostatographic process without negating the effect of the feedback means. The average of a predetermined number of sensed recording member reference voltages associated with image areas is compared to the reference voltage output of a single image area, producing a difference signal for controlling at least one process control parameter for the single image area, whereby the control of the parameter is responsive to short term variations in the output signal and is substantially non-responsive to long term variations in the output signal.

20 Claims, 3 Drawing Figures

DYNAMIC PROCESS CONTROL FOR ELECTROSTATOGRAPHIC MACHINES

BACKGROUND OF THE INVENTION

1. Field of the Invention

This invention relates to electrostatographic copying and/or printing machines, and more particularly to the maintenance of high image quality in the presence of transient changes in process control parameters.

2. Description of the Prior Art

In electrostatographic machines such as printers and copiers, image contrast, density, and color balance can be adjusted by changing certain process control parameters. Such parameters most frequently include primary voltage $V_0$, exposure E, and development station electrode bias voltage $V_B$. Other process control parameters which are less frequently used, but which are effective to control the image contrast, density, and color balance include the concentration of toner in the developer mixture, and the image transfer potential.

Techniques exist for regulating electrostatographic machine process control parameters so as to compensate for long term variations in the electrostatographic process. The phrase "long term" pertains to variations which would affect many successive images, and includes variations caused by such things as changes in toner concentration, wear of the image transfer member, aging of the exposure lamp, and atmospheric conditions. Generally, a test patch or patches are formed and developed on non-image areas of the transfer member. By feedback processes, abnormal toner density readings of the patches result in adjustments to at least some of the process control parameters to return the readings to nominal values.

Other techniques exist for regulating electrostatographic machine process control parameters so as to compensate for short term variations in the electrostatographic process. The phrase "short term" pertains to variations which would affect only one image or just a few successive images, and includes variations caused by such things as short duration electrical transients and differences in the frame-to-frame film thickness of the image transfer member. U.S. Pat. No. 2,956,487 which issued on Oct. 18, 1960 to Giaimo, and U.S. Pat. No. 3,611,982 which issued on Oct. 12, 1971 to Coriale et al show apparatus wherein the post-exposure photoconductor background voltage is sensed, and the voltage level is fed forward to adjust the bias at the development station, thereby maintaining the development bias at a predetermined level in relation to the photoconductor background voltage; normally a desirable goal.

While both feedback, to compensate for long term variations in the electrostatographic process, and feedforward, to compensate for short term variations, work well alone, they tend to cancel out their advantageous effects when used in combination. For example, a feedback adjustment of the primary charger and/or to the exposure control to change the background voltage in an attempt to correct an undesirable change in density would be substantially negated by a feedforward system which detects the change in the background voltage on the photoconductor and adjusts the development bias; resulting in zero change to the density of the developed image.

SUMMARY OF THE INVENTION

Accordingly, it is an object of the present invention to provide an electrostatographic machine having both (1) feedback means for adjusting process control parameters in response to long term variations in the electrostatographic process and (2) feedforward means for adjusting process control parameters in response to short term variations in the electrostatographic process without negating the effect of the feedback means.

The invention includes electrostatographic machine apparatus having means for sensing a reference voltage associated with an image area, and for converting the sensed voltage to an output signal. A reference signal is created by low pass filtering a plurality of output signals, and the reference signal is compared to the output signal for the given image area to produce a difference signal. The controlling means is regulated in response to the difference signal, whereby the controlling means is responsive to short term variations in the output signal and is substantially non-responsive to long term variations in the output signal.

In the preferred embodiment of the present invention, the low pass filtering is done by averaging a predetermined number of output signals, the reference voltage is sensed on the recording member following imagewise discharge of the associated image area, and the controlled parameter is the bias voltage on the electrode at the development station. The averaged reference voltages are preferably associated with successive image areas.

The invention and its advantages will become more apparent to those skilled in the art from the ensuing detailed description of preferred embodiments.

BRIEF DESCRIPTION OF THE DRAWINGS

The subsequent description of the preferred embodiments of the present invention refers to the attached drawings, wherein.

DESCRIPTION OF THE PREFERRED EMBODIMENT

Figure 1:
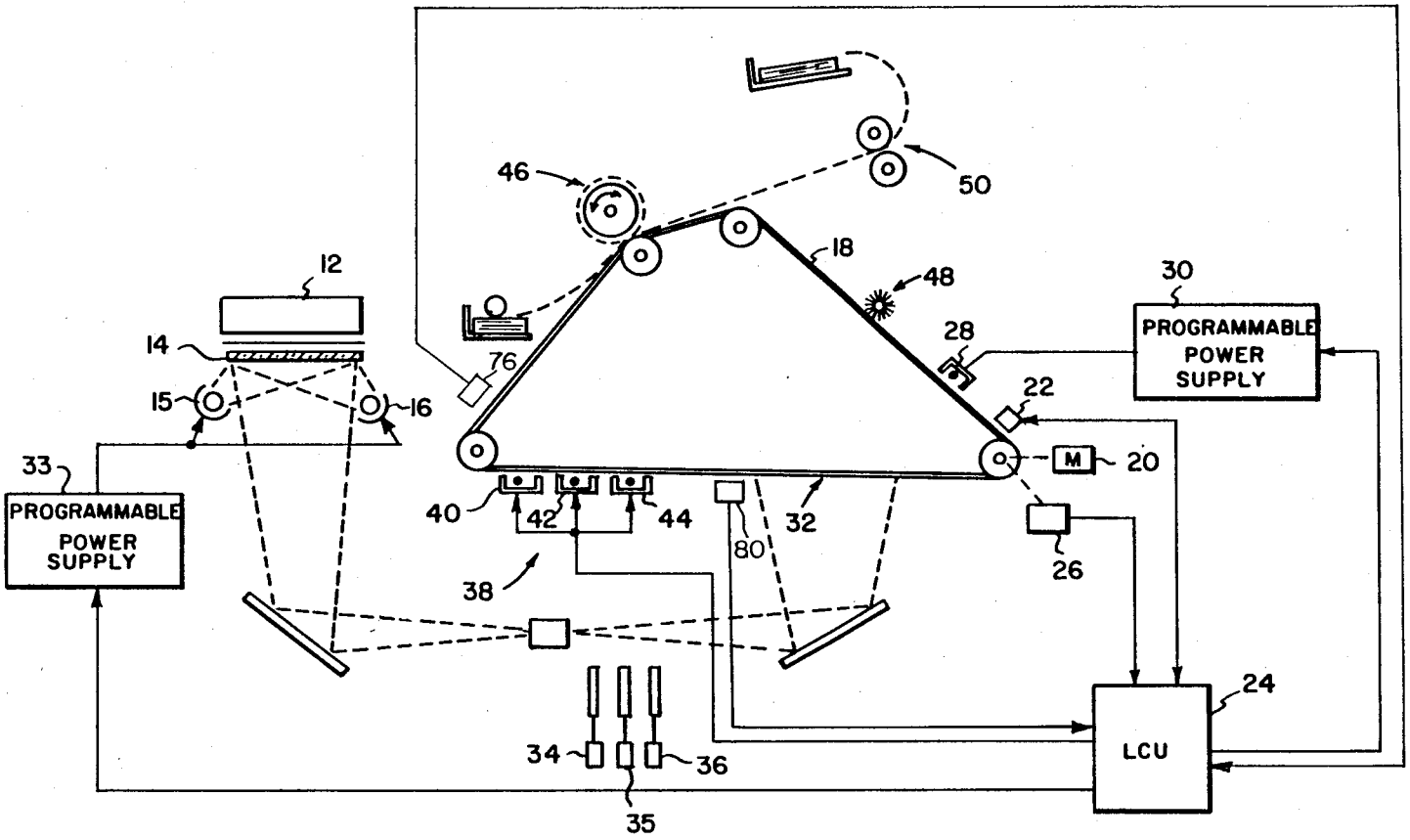
FIG. 1 is a schematic showing a side elevational view of an electrostatographic machine in accordance with the invention.

The present invention is described below in the environment of an electrophotographic copier. At the outset, it will be noted that although this invention is suitable for use with such machines, it also can be used with other types of electrostatographic copiers or printers.

CONTRAST AND EXPOSURE CONTROL

For a detailed explanation of the theory of copier contrast and exposure control by controlling initial voltage, exposure, and bias voltage, reference may be made to the following article: Paxton, Electrophotographic Systems Solid Area Response Model, 22 Photographic Science and Engineering 150 (May/June 1978). To facilitate understanding, the following terms are defined:

$V_B$=Development station electrode bias.

$V_0$=Primary voltage (relative to ground) on the photoconductor just after the charger. This is sometimes referred to as the "initial" voltage.

$V_F$=Photoconductor voltage (relative to ground) just after exposure.

$E_0$=Light produced by the flash lamps.

E=Actual exposure of photoconductor. Light produced by the flash lamps ($E_0$) is reflected off of a portion of a document having a particular density onto the photoconductor and causes a particular level of exposure E of the photoconductor.

Contrast and density control is achieved by the choice of the levels of $V_0$, $E_0$, and $V_B$.

FEEDER, EXPOSURE, AND RECORDING MEMBER

A three-color copier includes a recirculating feeder 12 positioned on top of an exposure platen 14. The feeder may be similar to that disclosed in commonly assigned U.S. Pat. No. 4,076,408, issued Feb. 28, 1979, wherein a plurality of originals can be repeatedly fed in succession to the exposure platen.

At exposure platen 14, originals are illuminated by a pair of xenon flashlamps 15 and 16 with an intensity $E_0$, as described in commonly assigned U.S. Pat. No. 3,998,541, issued Dec. 31, 1976. An image of the illuminated original is optically projected with an exposure intensity E onto one of a plurality of sequentially spaced, non-overlapping image areas of a moving recording member such as photoconductive belt 18.

Photoconductive belt 18 is driven by a motor 20 past a series of work stations of the copier. The belt includes timing marks which are sensed, such as by a signal generator 22 to produce timing signals to be sent to a computer controlled logic and control unit (LCU) 24. An encoder 26 also produces timing signals for the LCU. A microprocessor within LCU 24 has a stored program responsive to signals from generator 22 and encoder 26 for sequentially actuating the work stations.

THE WORK STATIONS

For a complete description of the work stations, see commonly assigned U.S. Pat. No. 3,914,046. Briefly, a charging station 28 sensitizes belt 18 by applying a uniform electrostatic charge of predetermined initial voltage $V_0$ to the surface of the belt. The output of the charger is controllable by a programmable power supply 30, which is in turn controlled by LCU 24 to adjust primary voltage $V_0$.

The inverse image of the original is projected onto the charged surface of belt 18 at an exposure station 32. The image dissipates the electrostatic charge and forms a latent charge image. A programmable power supply 33, under the supervision of LCU 24, controls the exposure $E_0$ (intensity and duration) of light produced by lamps 15 and 16. This, of course, adjusts the exposure E of belt 18, and thereby the voltage $V_F$ of the photoconductor just after exposure. For a specific example of such an exposure station and programmable power supply, see U.S. Pat. No. 4,150,324, issued Aug. 8, 1978.

The illustrated copier is adapted to reproduce three-color copies. The original is illuminated, for example, three times in succession to form three separate latent charge image frames of the original. On successive illuminations, a red filter 34, a green filter 35, or a blue filter 36 is inserted into the light path to form color separation latent charge images at exposure station 32. As understood in the art, provision may be made for a fourth exposure for areas to be developed in black, if desired. The timing of the flash of lamps 15 and 16 and the insertion of filters 34–36 are controlled by LCU 24.

Travel of belt 18 brings the areas bearing the latent charge images into a development area 38. The development area has a plurality of magnetic brush development stations, corresponding to the number of formed color separation images (plus black if used), in juxtaposition to, but spaced from, the travel path of the belt. Magnetic brush development stations are well known; for example, see U.S. Pat. Nos. 4,473,029 to Fritz et al and 4,546,060 to Miskinis et al.

When the color separation images are red, green, and blue, there are three development stations respectively containing complementary colored toner particles, i.e., cyan particles in station 40, magenta particles in station 42 and yellow particles in station 44. The toner particles are agitated in the respective developer stations to exhibit a triboelectric charge of opposite polarity to the latent imagewise charge pattern.

LCU 24 selectively activates the development stations in relation to the passage of the image areas containing corresponding latent color separation images through development area 38 to selectively bring one magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes, and are electrically connected to a variable supply or D.C. potential controlled by LCU 24 for adjusting the development electrode bias voltage $V_B$.

The copier also includes a transfer station 46 and a cleaning station 48, both fully described in commonly assigned U.S. patent application Ser. No. 809,546, filed Dec. 16, 1985. After transfer of the unfixed toner images to a copy sheet, such sheet is transported to a fuser station 50 where the image is fixed to the sheet.

LOGIC AND CONTROL UNIT (LCU)

Programming commercially available microprocessors is a conventional skill well understood in the art. The following disclosure is written to enable a programmer having ordinary skill in the art to produce an appropriate control program for such a microprocessor. The particlar details of any such program would depend on the architecture of the designated microprocessor.

Figure 2:
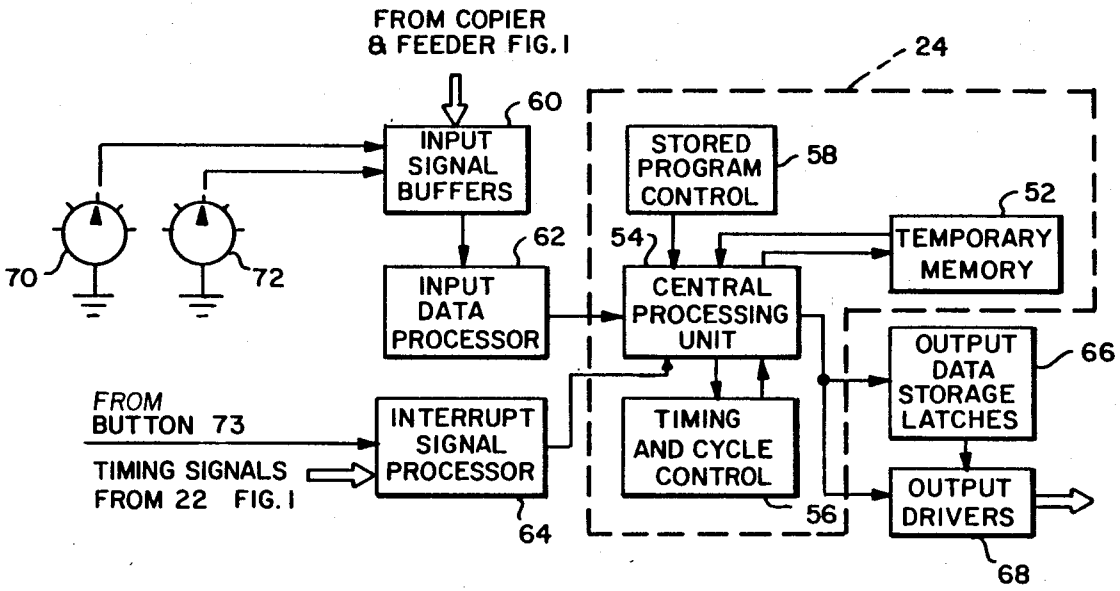
FIG. 2 is a block diagram of the logic and control unit shown in FIG. 1.

Referring to FIG. 2, a block diagram of a typical LCU 24 is shown with interfacing with copier 10 and feeder 12. The LCU consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

SET-UP OPERATION

Information representative of a particular set of machine process control parameters is designated by an exposure knob 70 and a contrast knob 72, which provide inputs to buffers 60. Located in stored program control 58 memory is a matrix array of such sets as described in a black and white copier in the above-identified Fiske et al U.S. Pat. No. 4,350,435. Adaptation to color if desired would readily be accomplished by one of ordinary skill in the art.

Control knobs 70 and 72 settings correspond to a plurality of sets of process control parameters, which in turn correspond to different $D_{in}/D_{out}$ response curves. The first knob 70 functions as an exposure control and translates the breakpoint of the $D_{in}/D_{out}$ curve. When knob 72 is turned, any one of nine different copy contrasts can be designated.

To make single or multiple copies (non-production run condition) of an original and to obtain a copy representative of the conditions designated by the exposure and contrast knobs, a special print copy button on connection 73 must be depressed. The depression of the button causes the copy to be produced in accordance with the $E_0$, $V_0$ and $V_B$ conditions specified by knobs 70 and 72.

During set-up, the operator identifies originals which require special consideration, and adjusts knobs 70 and 72 until copies of that original have the desired contrast and density. LCU 24 now enters into temporary memory 52 the $V_0$, $E_0$ and $V_B$ reference values for the entire length of each original that needed special consideration. The operator now returns knobs 70 and 72 to their normal position, if it is desired to make the other copies at this setting. The copier now initiates a production run of the multiple-original document with each copy having contrast and density in accordance with the stored process control parameter information, or with normal contrast and density, as applicable.

FEEDBACK CONTROL

Process control strategies generally utilize various sensors to provide real-time control of the electrostatographic process and to provide "constant" image quality output from the user's perspective.

One such sensor may be a densitometer 76 to monitor development of test patches in non-image areas of photoconductive belt 18, as is well known in the art. The densitometer is intended to insure that the transmittance or reflectance of a toned patch on the belt is maintained. The densitometer may consist of an infrared light emitting diode (LED) which shines through the belt (transmittance) or is reflected by the belt (reflectance) onto a photodiode. The photodiode generates a voltage proportional to the amount of light transmitted or reflected from a toned patch. This voltage is compared to the voltage generated due to transmittance or reflectance of a bare patch to give a signal representative of an estimate of toned density. This signal is transmitted to LCU 24, where it may be used to adjust $V_0$, $E_0$, $V_B$, and/or the concentration of toner particles in the developer mixture.

FEEDFORWARD CONTROL

As the name indicates, feedforward process control detects system noise or disturbance as it occurs, and begins correcting compensation immediately. Feedforward acts in an anticipatory manner before the results of noise or disturbance can affect the results, whereas feedback control acts after the fact in a compensatory manner. In general, feedforward control measures a short term disturbance or noise directly or indirectly, and commands an appropriate action to inhibit, by elimination or reduction, the impact of the disturbance or noise on the system before the final output is affected.

Figure 3:
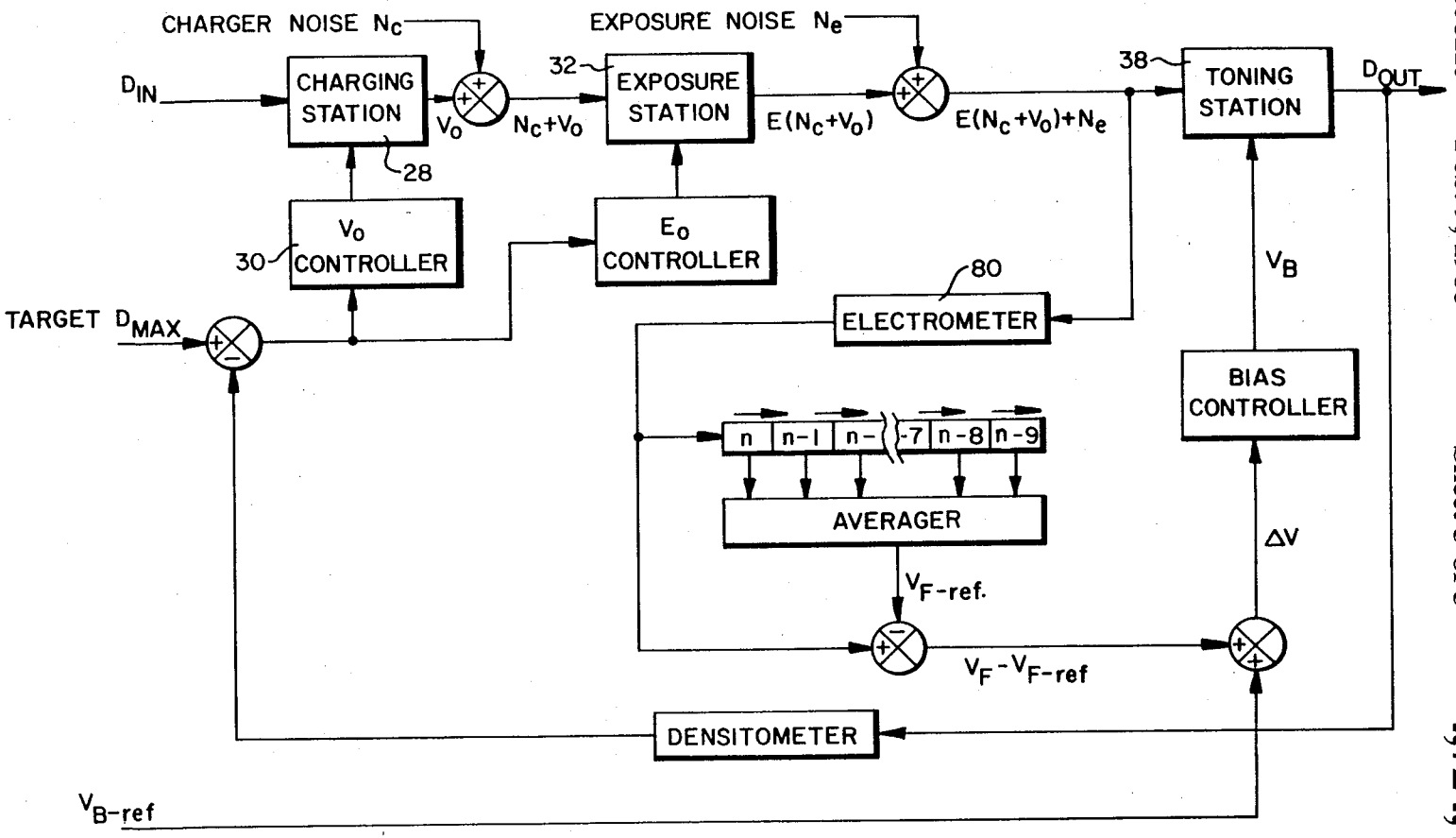
FIG. 3 is a diagram of the process for deriving a development station electrode bias for the electrostatographic machine of FIG. 1.

FIG. 3 is a block diagram of the process of the preferred embodiment of the present invention, accounting for noise and disturbances $N_c$ of the charger and $N_e$ of the exposure systems. Post-exposure photoconductor voltage $V_F$ on a test patch given by the equation:

$$V_F = E(N_c + V_0) + N_e$$

Voltage $V_F$ is sensed by an electrometer 80 (FIGS. 1 and 3) and inputed to the process control microprocessor of LCU 24.

LCU 24 calculates a reference signal $V_{F\text{-}ref}$, which is the output of a digital low pass filter algorithm whose input is $V_F$. Such a filter may be of the finite impulse response (FIR), or infinite impulse response (IIR) variety, which can respectively be expressed for example as follows:

$$V_{f-ref}(n) = f[V_{f(n)}, V_{f(n-1)}, \ldots, V_{f(n-9)}]$$

and $$V_{f-ref}(n) = g[V_{f-ref(n-1)}, V_{f(n)}].$$

In the preferred embodiment, of the present invention, the filter output is of the FIR variety and is computed as the average of a predetermined number of immediately preceding electrometer patch readings for a particular color.

Voltage $V_F$ is substracted from reference signal $V_{F-ref}$ and the difference signal is saved until the corresponding part of the photoconductor belt reaches the development zone, at which time the difference signal is added to a reference bias voltage $V_{B-ref}$ to adjust toning station bias $V_B$ so as to maintain a nominal potential difference $\Delta V$ between $V_F$ and $V_B$. The feedforward algorithm has the mathematical form:

$$V_B = V_{B-ref} + V_F - V_{F-ref}$$

where all values are absolute.

In prior art systems, the nominal potential difference $\Delta V$ is fixed. However, for the algorithm to be compatible with the previously discussed feedback algorithms running simultaneously which gradually adjust $V_0$ and $E_0$, the nominal potential difference $\Delta V$ must be allowed to slowly change. That is why $V_{F-ref}$ of the equation is updated after each image frame, and is the average of a predetermined number of preceding electrometer patch readings, such as for example ten (10) immediately preceding readings for a given color. That is, the reference photoconductor voltage is expressed:

$$V_{F\text{-}ref}(n) = \left[ \sum_{i=n-9}^{n} V_F(i) \right] / 10$$

By averaging the readings for the photoconductor voltage, good short term stability of $V_{F-ref}$ is obtained for the feedforward algorithm, while being reasonably responsive to the adjustments to $V_0$ and $E_0$ required for long-term density maintenance.

Preferably, the ten (10) readings are equally weighted in computing the average. Alternatively, a weighted average may be computed, for example, by weighting the more recent readings more heavily than the earlier reading. For best results, a modified calculation of $V_{F-ref}$ may be done during the first ten prints of a run; before the "moving window" has filled.

The invention has been described in detail with particular reference to preferred embodiments thereof, but it will be understood that variations and modifications can be effected within the spirit and scope of the invention. For example, the algorithm of the preferred embodiment is suitable for computing a development station electrode bias based on post-exposure film voltage measurements. However, one might choose to compute exposure parameter $E_0$ or development bias $V_B$ based on post-charging film voltage $V_0$ measurements. While such a system would not compensate for short term variations at the exposure station, and is therefore considered to be generally inferior to the preferred embodiment, the present invention is intended to encompass such variations.

What is claimed is:

1. In an electrostatographic machine including (1) means for substantially uniformly charging a recording member, having image areas, to a primary voltage, (2) means for imagewise discharging the charged recording member to produce discrete latent charge images, (3) means, including a biased electrode, for developing the latent charge images, and (4) means for controlling at least one of the discharging means and the electrode bias for a given image area; the improvement comprising:

means for sensing a reference voltage associated with an image area, and for converting the sensed voltage to an output signal;

means for creating a reference signal by low pass filtering a plurality of output signals;

means for comparing the output signal for the given image area to said reference signal to produce a difference signal; and means for regulating the controlling means in response to said difference signal, whereby the controlling means is responsive to short term variations in the output signal and is substantially non-responsive to long term variations in the output signal.

2. The improvement as defined in claim 1 wherein:

the reference voltage is sensed on the recording member following imagewise discharge of the associated image area; and the controlling means operates on the electrode bias.

3. The improvement as defined in claim 1 wherein the low pass filtering means averages a predetermined number of output signals to create said reference signal.

4. The improvement as defined in claim 3 wherein said predetermined number of output signals are associated with successive image areas.

5. The improvement as defined in claim 3 wherein said predetermined number is about ten.

6. In an electrostatographic machine having (1) means for substantially uniformly charging a recording member, having image areas, to a primary voltage, (2) means for imagewise discharging the charged recording member to produce a latent charge image, (3) developing station means, including an electrode, for depositing toner on the latent charge image, and (4) means for electrically biasing the electrode at a nominal bias voltage level; the improvement comprising:

means for sensing a reference voltage associated with an image area prior to the image area reaching the development station means, and for converting the sensed voltage to an output signal;

means for creating a reference signal by low pass filtering a plurality of output signals;

means for comparing the output signal for a given image area to said reference signal to produce a difference signal; and means for regulating the biasing means in response to said difference signal, whereby the electrode bias is responsive to short term variations in the output signal and is substantially non-responsive to long term variations in the output signal.

7. The improvement as defined in claim 5 wherein the reference voltage is sensed on the recording member following imagewise discharge of the associated image area.

8. The improvement as defined in claim 6 wherein the low pass filtering means averages a predetermined number of output signals to create said reference signal.

9. The improvement as defined in claim 8 wherein said predetermined number of output signals are associated with successive image areas.

10. The improvement as defined in claim 8 wherein said predetermined number is about ten.

11. In an electrostatographic machine including (1) means for substantially uniformly charging a recording member to a primary voltage, (2) means for imagewise discharging the charged recording member to produce discrete areas with latent charge images and test patches, (3) means, including a biased electrode, for depositing toner on the image areas and test patches, and (4) means for controlling at least one of the discharging means and the electrode bias for a given image area; the improvement comprising:

feedback means for sensing the density of deposited toner on the test patch and for regulating at least one of the charging means and the discharging means for long term control of the density of toner deposited on the test patches;

means for sensing a reference voltage associated with an image area, and for converting the sensed voltage to an output signal;

means for creating a reference signal by low pass filtering a plurality of output signals;

means for comparing the output signal for the given image area to said reference signal to produce a difference signal; and means for regulating the controlling means in response to said difference signal, whereby the controlling means is responsive to short term variations in the output signal and is substantially non-responsive to long term variations in the output signal.

12. The improvement as defined in claim 11 wherein:

the reference voltage is sensed on the recording member following imagewise discharge of the associated image area; and the controlling means operates on the electrode bias.

13. The improvement as defined in claim 11 wherein the low pass filtering means averages a predetermined number of output signals to create said reference signal.

14. The improvement as defined in claim 13 wherein said predetermined number of output signals are associated with successive image areas.

15. The improvement as defined in claim 13 wherein said predetermined number is about ten.

16. In an electrostatographic machine having (1) means for substantially uniformly charging a recording member, having image areas, to a primary voltage, (2) means for imagewise discharging the charged recording member to produce a latent charge image and a test patch, (3) developing station means, including an electrode, for depositing toner on the latent charge image, and (4) means for electrically biasing the electrode at a nominal bias voltage level; the improvement comprising:

feedback means for sensing the density of deposited toner on the test patch and for regulating at least one of the charging means and the discharging means for long term control of the density of toner deposited on the test patches;

means for sensing a reference voltage associated with an image area prior to the image area reaching the development station means, and for converting the sensed voltage to an output signal;

means for creating a reference signal by low pass filtering a plurality of output signals;

means for comparing the output signal for a given image area to said reference signal to produce a difference signal; and means for regulating the biasing means in response to said difference signal, whereby the electrode bias is responsive to short term variations in the output signal and is substantially non-responsive to long term variations in the output signal.

17. The improvement as defined in claim 16 wherein the reference voltage is sensed on the recording member following imagewise discharge of the associated image area.

18. The improvement as defined in claim 16 wherein the low pass filtering means averages a predetermined number of output signals to create said reference signal.

19. The improvement as defined in claim 18 wherein said predetermined number of output signals are associated with successive image areas.

20. The improvement as defined in claim 18 wherein said predetermined number is about ten.

* * * * *